US007996925B2

(12) United States Patent
Chiang

(10) Patent No.: US 7,996,925 B2
(45) Date of Patent: Aug. 16, 2011

(54) SWIMMING GOGGLES

(76) Inventor: Herman Chiang, Chung-Ho (TW)

( * ) Notice: Subject to any disclaimer, the term of this patent is extended or adjusted under 35 U.S.C. 154(b) by 873 days.

(21) Appl. No.: 12/007,717

(22) Filed: Jan. 15, 2008

(65) Prior Publication Data

US 2009/0165192 A1 Jul. 2, 2009

(30) Foreign Application Priority Data

Dec. 28, 2007 (TW) ..... 96222470 U

(51) Int. Cl.
*A61F 9/02* (2006.01)

(52) U.S. Cl. ..... 2/445

(58) Field of Classification Search ..... 2/426, 428, 2/442, 445, 452, 440; 24/68 E; 351/43, 155
See application file for complete search history.

(56) References Cited

U.S. PATENT DOCUMENTS

| | | | | |
|---|---|---|---|---|
| 5,467,508 | A * | 11/1995 | Feng | 24/68 SK |
| 6,070,272 | A * | 6/2000 | Chiang | 2/442 |
| 7,640,633 | B2 * | 1/2010 | Chou | 24/68 E |
| 7,823,226 | B2 * | 11/2010 | Chou | 2/448 |
| 2003/0208835 | A1 * | 11/2003 | Pan | 2/428 |
| 2009/0229086 | A1 * | 9/2009 | Chiang | 24/170 |

* cited by examiner

*Primary Examiner* — Katherine Moran
(74) *Attorney, Agent, or Firm* — Cheng-Ju Chiang

(57) ABSTRACT

Swimming goggles include a frame unit, lenses assembled on the frame unit, and a strap unit. The strap unit comprises a head strap with two free ends, and buckles for securing and adjusting the head strap. Each buckle includes a base and a control portion. The base has a first reception portion defining a first slot, and a second reception portion defining a second slot. The control portion is provided between the first reception portion and the second reception portion, and includes at least a biasing arm neighboring the first slot or the second slot. The biasing arm includes a biasing portion for abutting against the head strap, and an operating portion. When the operating portions are operated to release the biasing portion, the head strap is allowed to be adjusted. Therefore the length of the head strap can be adjusted conveniently.

16 Claims, 5 Drawing Sheets

SWIMMING GOGGLES

BACKGROUND OF THE INVENTION

1. Field of the Invention

The present invention relates to swimming goggles, and particularly to swimming goggles with an adjustable head strap.

2. Related Art

Conventional swimming goggles have a head strap adjustable by buckles. The buckle is generally shaped with a couple of loops adjoining to each other. The two free ends of the head strap respectively extend through the loops and are overlapped. As changing length of the head strap, friction produced by the overlapped part of the head strap blocks movement, making adjustment cumbersome.

Another fashion of conventional buckles are respectively disposed on left sides and right sides of the eyeglasses frame. Each conventional buckle forms a biasing arm, which biases against denticulate grooves of the head strap, thus the head strap is allowed to be adjusted in a single direction only (namely shortening length of the head strap). To loosen the head strap, the biasing arm is disengaged from the denticulate grooves. However, the conventional buckles are strictly required in manufacture, and therefore lead to high cost. So, it is desired to make buckles of swimming goggles be easily used and manufactured.

Furthermore, swimming goggles with a left frame, a right frame and a connecting portion integrated together, demand material which enables lenses retained in the left frame and the right frame. The material should not be so soft that can not fix the lenses and resist water pressure. The material is therefore limited to given rigidness, and a pad formed on the left frame and the right frame can not be soft sufficient to touch a user's face comfortably when wearing. Additionally, because the integrated swimming goggles opt for material with given rigidness, the connecting portion between the left frame and the right frame is too stiffened to suit for users with different face profiles, and the left frame and the right frame can not fit close to the user's face, thus taking risk of water leakage.

SUMMARY OF THE INVENTION

Accordingly, an object of the present invention is to provide swimming goggles which provide comfortable feeling for users and prevent from water leakage effectively and which have buckles guiding and controlling a head strap for facilitating convenient adjustment of the head strap.

The swimming goggles comprise a frame unit, lenses assembled on the frame unit, and a strap unit. The strap unit comprises a head strap with two free ends, and buckles for securing and adjusting the head strap. Each buckle includes a base and a control portion. The base has a first reception portion and a second reception portion. The first reception portion defines a first slot, and the second reception portion defines a second slot. The control portion is provided between the first reception portion and the second reception portion, and includes at least a biasing arm neighboring the first slot or the second slot. The biasing arm includes a biasing portion for abutting against the head strap, and an operating portion. The head strap is adjustable when the operating portions are operated to release the biasing portion.

The frame unit includes a left frame, a right frame, a connecting member connecting the left frame and the right frame, a nose bridge between the left frame and the right frame, a pair of support portions respectively on the left frame and the right frame, and pads. The nose bridge and the support portions are made of hard material, while the left frame, the right frame, the connecting member and the pads are made of soft material. The nose bridge forms a central portion and wings respectively on opposite sides of the central portion. The support portions respectively include linking portions on ends thereof, ferrules on another ends thereof, and middle portions between the linking portions and the ferrules. The wings and the linking portions preliminarily secure the lenses. The central portion and the wings of the nose bridge, and the middle portion and the linking portions of the support portions, are enveloped by soft material, whereby the frame unit is integrally made of soft material and hard material.

DESCRIPTION OF THE PREFERRED EMBODIMENTS

Figure 1:
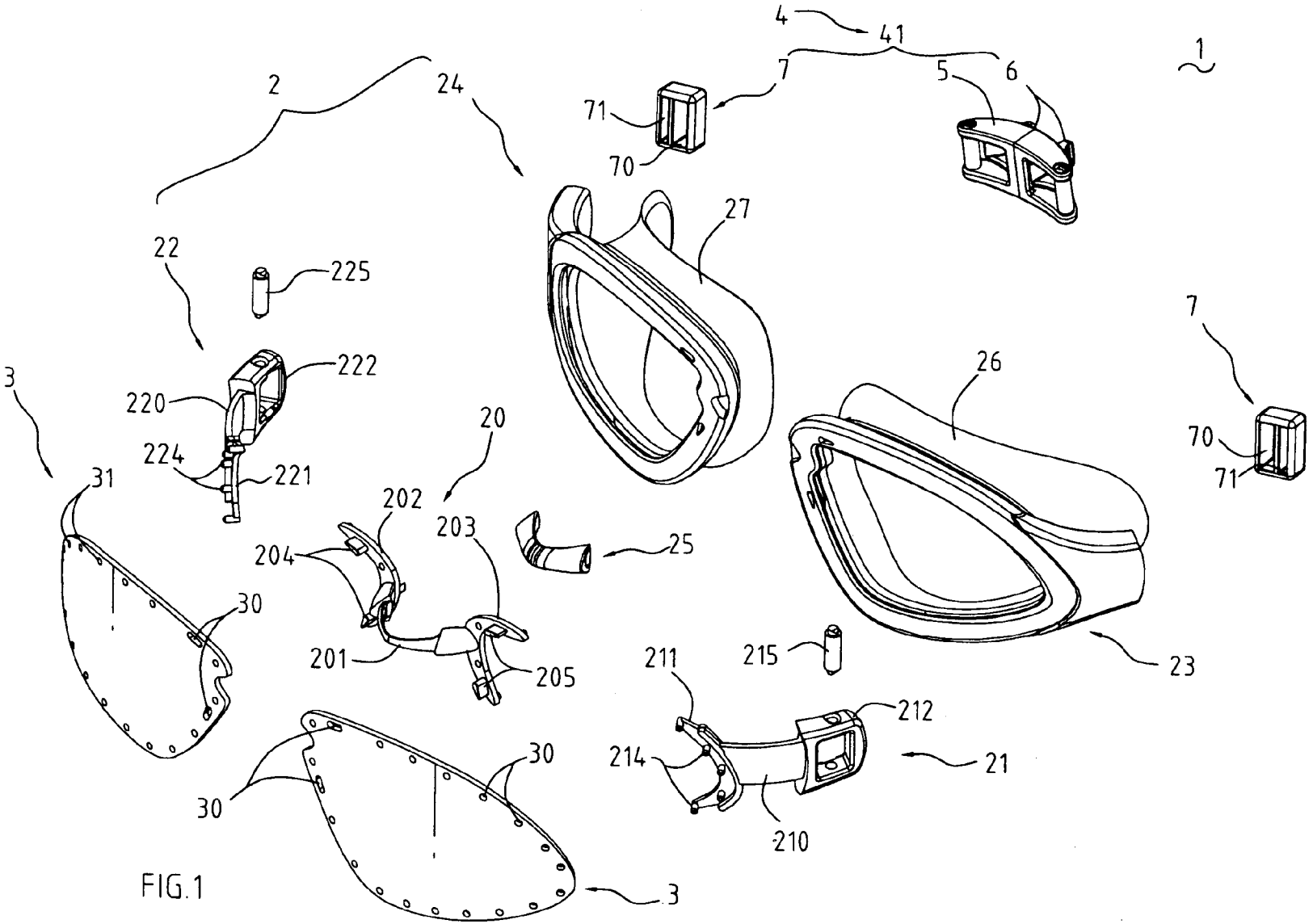
FIG. 1 is an exploded view of swimming goggles of the present invention.

With reference to FIG. 1, swimming goggles 1 in accordance with the present invention comprise a frame unit 2, lenses 3 assembled on the frame unit 2, and a strap unit 4. The frame unit 2 includes a left frame 23, a right frame 24, a connecting member 25 connecting the left frame 23 and the right frame 24, a nose bridge 20 between the left frame 23 and the right frame 24, a pair of support portions 21, 22 respectively on the left frame 23 and the right frame 24, and pads 26, 27. The nose bridge 20 and support portions 21, 22 are made of hard material, for example, PP material. While the left frame 23, the right frame 24, the connecting member 25 and the pads 26, 27 are made of soft material. The nose bridge 20 forms a central portion 201 and wings 202, 203 respectively on opposite sides of the central portion 201. The central portion 201 is a strip which has a middle thinner than both ends thereof. The wings 202, 203 are substantially arcuate for fitting to inward rims of the lenses 3, and form a number of protuberances 204, 205 thereon. Assembling holes 30 are defined in outer rims of the lenses 3 for corresponding to the protuberances 204, 205.

The support portions 21, 22 respectively include linking portions 211, 221 on ends thereof, ferrules 212, 222 on another ends thereof, and planar middle portions 210, 220 between the linking portions 210, 220 and the ferrules 212, 222. The ferrules 212, 222 respectively have partitioning bars 215, 225, respectively defining guiding holes 213, 223 (see FIG. 2). The linking portions 211, 221 are arcuate for fitting to outward rims of the lenses 3. A number of protrusions 214, 224 are formed on the linking portions 211, 221, and mounting holes 31 are defined in outer rims of the lenses 3 for corresponding to the protrusions 214, 224. The protuberances 204, 205 of the wings 202, 203 lock with the assembling holes 30, and the protrusions 214, 224 of the linking portions 211, 221 lock with the mounting holes 31, preliminarily securing the lenses 3.

Figure 6:
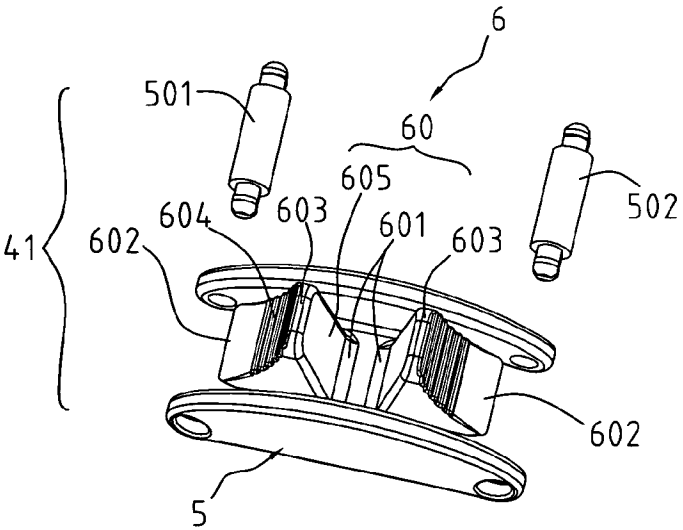
FIG. 6 is an exploded view of a buckle of the swimming goggles of FIG. 1.
Figure 7:
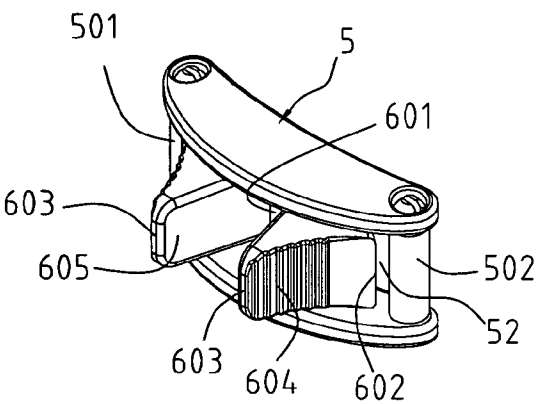
FIG. 7 is an assembled view of the buckle of FIG. 6.

The left frame 23, the right frame 24 and the connecting member 25 are integrally formed and are made of thermal plastic rubber (TPR). Alternatively, the left frame 23, the right frame 24 and the connecting member 25 are made of Silica gel or other soft material. Please see FIGS. 3 though 5, the left frame 23, the right frame 24 and the connecting member 25 unitarily envelope the central portion 201 and the wings 202, 203 of the nose bridge 20, and the middle portions 210, 220 and the link portions 211, 221. The pads 26, 27 are integrated formed with the left frame 23 and the right frame 24. Thus, frame unit 2 is unitarily formed of mixture of hard material and soft material Referring to FIG. 2 and FIGS. 6-9, the strap unit 4 comprises a head strap 40 and buckles 41 for retaining and adjusting the head strap 40. The head strap 40 has two free ends 401, 402 respectively forming acute tips 404, 405 with particular thickness. A plurality of stop grooves 403 is defined adjacent to the free ends 401, 402. As shown in FIG. 6, each buckle 41 includes a base 5, a control portion 6, and an anchoring portion 7 (see FIG. 1). The base 5 has a first reception portion (not labeled) and a second reception portion (not labeled) which respectively define a first slot 51 and a second slot 52. Side shafts 501, 502 are respectively disposed on the first reception portion and a second reception portion. The free ends 401, 402 of the head strap 40 respectively extend through the first slot 51 and the second slot 52 and are pulled about the side shafts 501, 502.

The control portion 6 is provided between the first slot 51 and the second slot 52 for facilitating adjustment of the head strap 40, and is integrated with the base 5. The control portion 6 forms a couple of biasing arms 60. The biasing arms 60 are parallel to each other and have identical shape. Each biasing arm 60 has an engaging portion 601 connecting with the base 5, a biasing portion 602 respectively neighboring the first slot 51 or the second slot 52, and an operating portion 603. The engaging portions 601 of the biasing arms 60 respectively connect with the base 5, whereby the biasing arms 60 are connected. A first inclined surface 604 is formed between the biasing portion 602 and the operation portion 603 of each biasing arm 60, and is arcuate and substantially coarse to enhance friction. A second inclined surface 605 is formed between the biasing portion 602 and the engaging portion 601 of each biasing arm 60. As directed by the dash line in FIG. 9, the biasing portions 602 abut against the stop grooves 403 of the head strap 40. To adjust the head strap 40, the operating portions 603 move toward each other, and the biasing portions 602 move toward each other, too. In this way, the biasing portions 602 disengage from the stop grooves 403. The anchoring portion 7 of each buckle 41 defines a first positioning hole 70 and a second positioning hole 71 respectively for receiving the free ends 401, 402 of the head strap 40.

Figure 2:
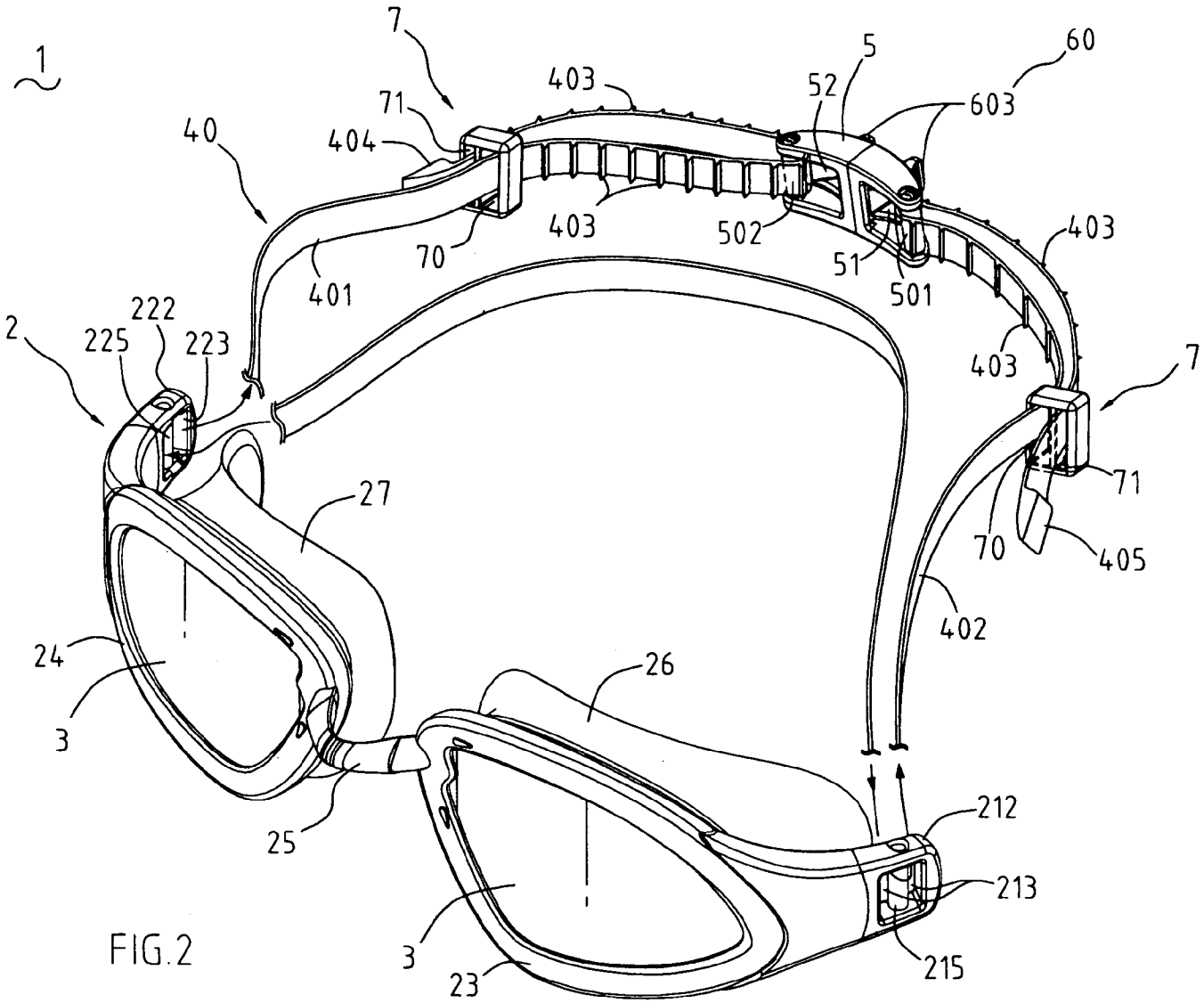
FIG. 2 is an assembled view of the swimming goggles of FIG. 1.
Figure 3:
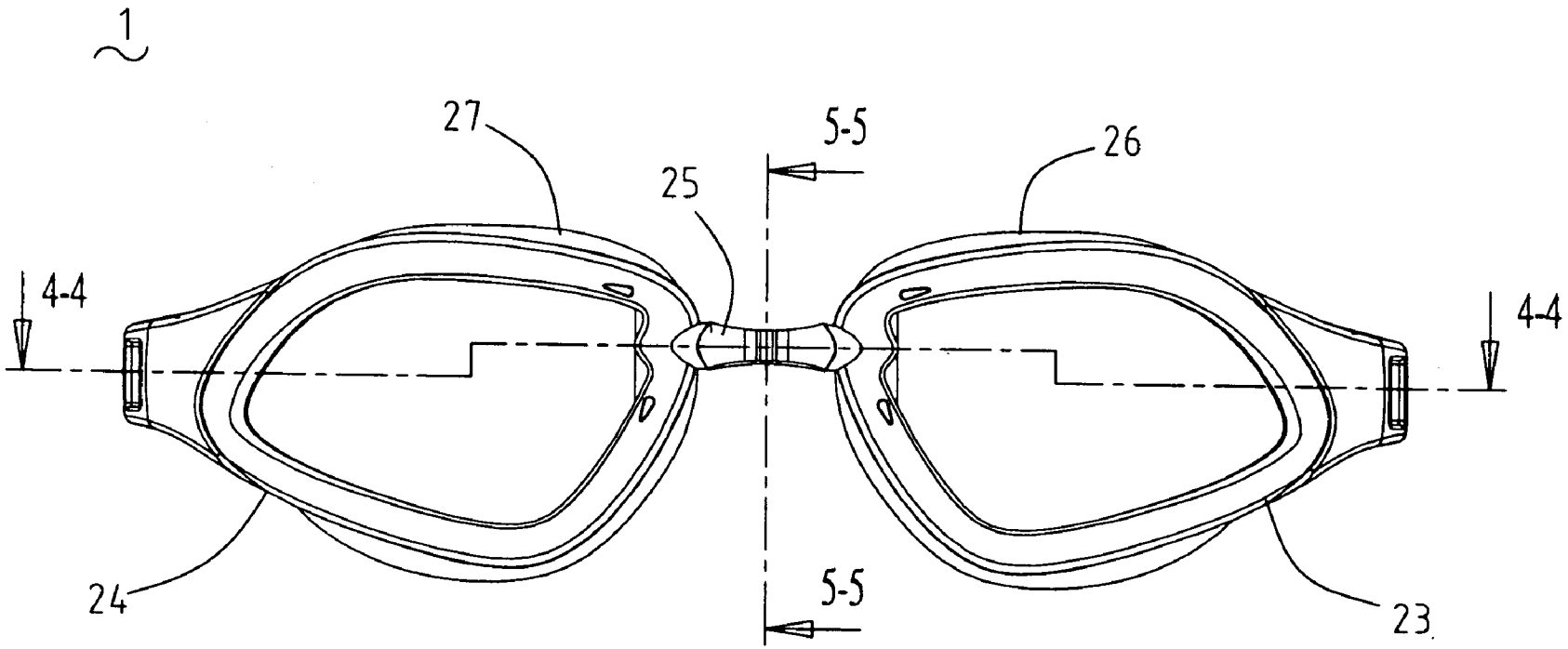
FIG. 3 is a front view of a frame unit of the swimming goggles of FIG. 1.
Figure 4:
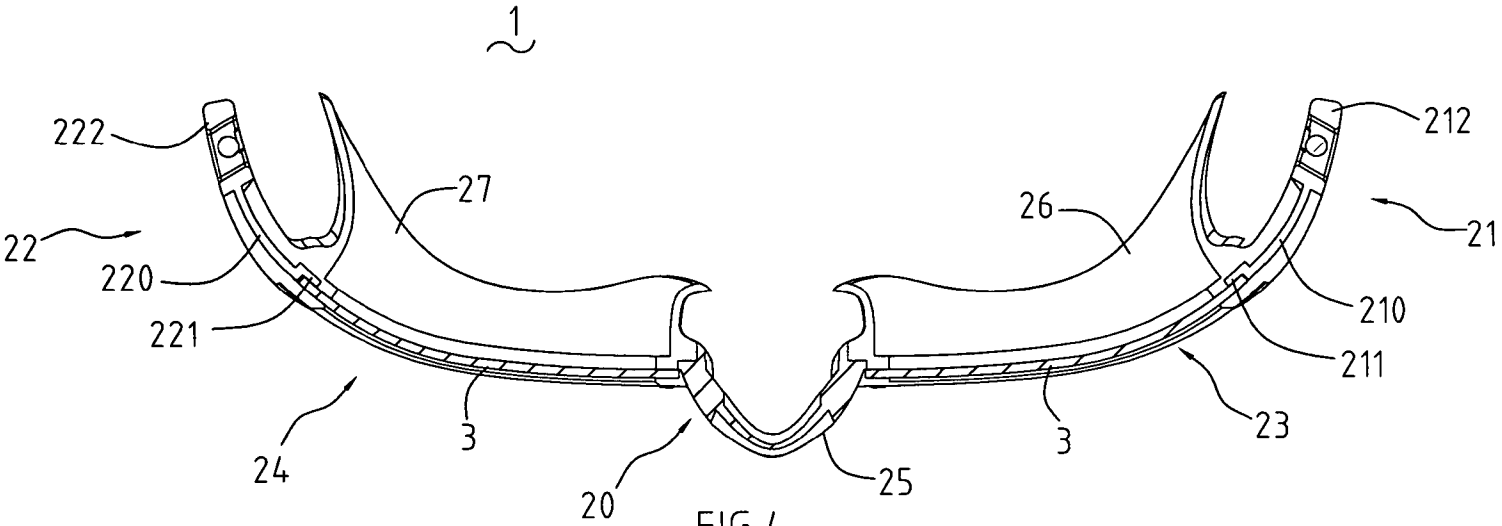
FIG. 4 is a cross-sectional view taken along the line 4-4 in FIG. 3.
Figure 5:
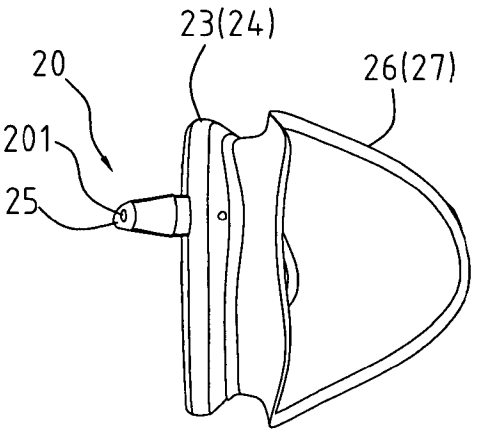
FIG. 5 is a cross-sectional view taken along the line 5-5 in FIG. 3.
Figure 8:
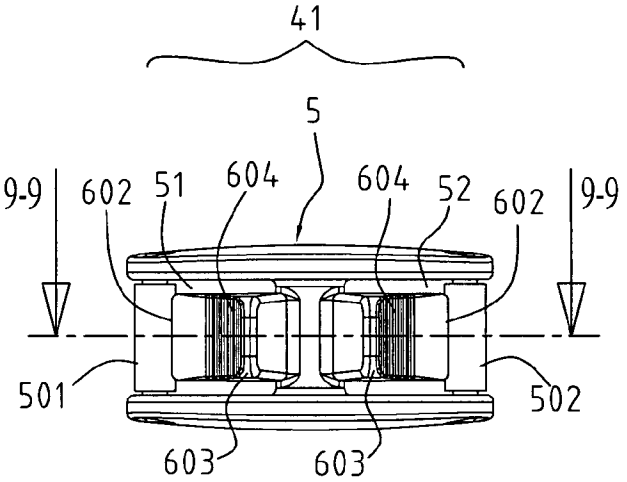
FIG. 8 is a front view of the buckle of FIG. 7.
Figure 9:
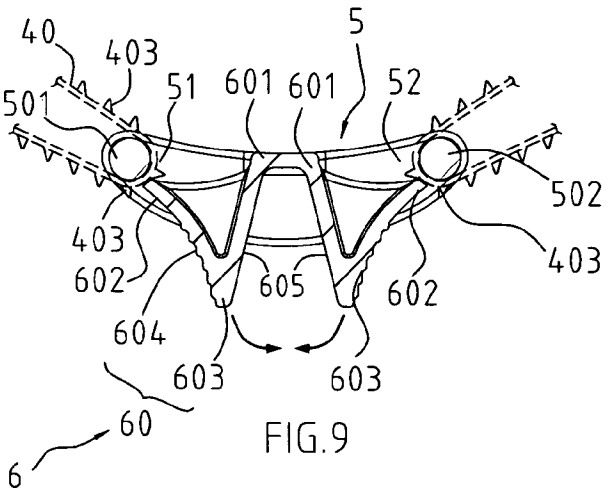
FIG. 9 is a cross-sectional view taken along the line 9-9 in FIG. 8.

Referring to FIG. 1, during assembly of the swimming goggles 1, the lenses 3, the nose bridge 20 and the support portions 21, 22 are assembled firstly. The protuberances 204, 205 of the wings 202, 203 lock with the assembling holes 30, and the protrusions 214, 224 of the linking portions 211, 221 lock with the mounting holes 31, preliminarily securing the lenses 3. The central portion 201 and the wings 202, 203 of the nose bridge 20, as well as the middle portions 210, 220 and the link portions 211, 221 of the support portions 21, 22, are unitarily encapsulated. Thus, the frame unit 2 is unitarily formed and is made of mixture of soft material and hard material, as shown in FIG. 2. The free ends 401, 402 of the head strap 40 (ghosted line in FIG. 2) are pulled outwardly to circle about the guiding holes 213, 223 of the ferrules 212, 222, and go through the first positioning holes 70 of the anchoring portions 7, then through the first slots 51 and the second slots 52, and finally through the second positioning holes 70 of the anchoring portions 7. When assembled, the biasing portions 602 abut against the stop grooves 403 on the free ends 401, 402 of the head strap 40, where the head strap 40 is permitted to move outward only, namely shortening the head strap 40. For lengthening the head strap 40, as shown in FIG. 9, the operating portions 603 are pressed facing to each other, tilting the biasing portions 602. The biasing portions 602 therefore disengage from the stop grooves 403, and the head strap 40 is free to be loosened.

The present examples and embodiments are to be considered in all respects as illustrative and not restrictive, and the invention is not to be limited to the details given herein. Numerous modifications, changes, variations, substitutions and equivalents will occur to those skilled in the art without departing from the spirit and scope of the present invention as defined by the appended claims.

The invention claimed is:

1. Swimming goggles comprising a frame unit, lenses assembled on the frame unit, and a strap unit, said strap unit comprising a head strap with free ends, and a buckle for securing and adjusting the head strap, the buckle including:

a base having a first reception portion and a second reception portion, the first reception portion defining a first slot, and the second reception portion defining a second slot; and a control portion provided between the first reception portion and the second reception portion, and including at least a biasing arm neighboring the first slot or the second slot, the biasing arm including a biasing portion for abutting against the head strap, and an operating portion, the head strap being adjustable when the operating portions are operated to release the biasing portion;

wherein the frame unit includes a left frame, a right frame, a connecting member connecting the left frame and the right frame, a nose bridge between the left frame and the right frame, a pair of support portions respectively on the left frame and the right frame, and pads, the nose bridge and the support portions being made of hard material, while the left frame, the right frame, the connecting member and the pads being made of soft material, the nose bridge forming a central portion and wings respectively on opposite sides of the central portion, the support portions respectively including linking portions on ends thereof, ferrules on another ends thereof, and middle portions between the linking portions and the ferrules, the wings and the linking portions securing the lenses, the central portion and the wings of the nose bridge and the middle portion and the linking portions being enveloped by soft material, whereby the frame unit is integrally formed of soft material and hard material.

2. The swimming goggles as claimed in claim 1, wherein the control portion is integrated with the base and forms a pair of biasing arms, the biasing arms being parallel to each other and having identical shape, each biasing arm having an engaging portion, the biasing portion and the operating portion, the engaging portion connecting with the base, the biasing portion respectively neighboring the first slot or the second slot, a first inclined surface being formed between the biasing portion and the operation portion, a second inclined surface being formed between the biasing portion and the engaging portion, when the operating portions move toward each other, the biasing portions moving toward each other, releasing the biasing portions.

3. The swimming goggles as claimed in claim 2, wherein the first inclined surface is arcuate.

4. The swimming goggles as claimed in claim 2, wherein the first inclined surface is substantially coarse to enhance friction.

5. The swimming goggles as claimed in claim 1, wherein the strap unit further comprises anchoring portions, each anchoring portion defining a first positioning hole and a second positioning hole respectively for receiving free ends of the head strap.

6. The swimming goggles as claimed in claim 5, wherein acute tips are formed on the free ends of the head strap and have particular thickness, a plurality of stop grooves being defined adjacent to the free ends of the head strap.

7. The swimming goggles as claimed in claim 1, wherein the central portion of the nose bridge is a strip which has a middle thinner than both ends thereof.

8. The swimming goggles as claimed in claim 7, wherein the middle portions of the support portions are planar, and the ferrules define two guiding holes.

9. The swimming goggles as claimed in claim 1, wherein the wings are substantially arcuate for fitting to inward rims of the lenses, and form a number of protuberances thereon, assembling holes being defined in outer rims of the lenses for corresponding to the protuberances, and wherein the linking portions are arcuate for fitting to outward rims of the lenses, and form a number of protrusions thereon, mounting holes being defined in outer rims of the lenses for corresponding to the protrusions.

10. The swimming goggles as claimed in claim 1, wherein the soft material is thermal plastic rubber or silica gel, and wherein the hard material is PP (polypropylene) material.

11. Swimming goggles comprising a frame unit, lenses assembled on the frame unit, and a strap unit, said frame unit including:

a nose bridge and a pair of support portions being made of hard material, the nose bridge forming a central portion and wings respectively on opposite sides of the central portion, the support portions respectively including linking portions on ends thereof, ferrules on another ends thereof, and middle portions between the linking portions and the ferrules, the wings and the linking portions securing the lenses; and a left frame, a right frame and a connecting member being made of soft material, and integrally enveloping the central portion and the wings of the nose bridge and the middle portion and the linking portions, thereby making the left frame, the right frame and the connecting member made of soft material and hard material.

12. The swimming goggles as claimed in claim 11, wherein the central portion of the nose bridge is a strip which has a middle thinner than both ends thereof.

13. The swimming goggles as claimed in claim 12, wherein the middle portions of the support portions are planar, and the ferrules define two guiding holes.

14. The swimming goggles as claimed in claim 11, wherein the wings are substantially arcuate for fitting to inward rims of the lenses, and form a number of protuberances thereon, assembling holes being defined in outer rims of the lenses for corresponding to the protuberances, and wherein the linking portions are arcuate for fitting to outward rims of the lenses, and form a number of protrusions thereon, and mounting holes being defined in outer rims of the lenses for corresponding to the protrusions.

15. The swimming goggles as claimed in claim 11, wherein the soft material is thermal plastic rubber or silica gel, and wherein the hard material is PP (polypropylene) material.

16. The swimming goggles as claimed in claim 11, wherein pads are integrated with the left frame and the right frame.

* * * * *